US009890565B2

(12) United States Patent
Shiu et al.

(10) Patent No.: US 9,890,565 B2
(45) Date of Patent: Feb. 13, 2018

(54) LOCK STRUCTURE

(71) Applicant: TAIWAN FU HSING INDUSTRIAL CO., LTD., Kaohsiung (TW)

(72) Inventors: Jiun-Nan Shiu, Kaohsiung (TW); Shih-Min Lu, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 80 days.

(21) Appl. No.: 14/582,317

(22) Filed: Dec. 24, 2014

(65) Prior Publication Data

US 2016/0060905 A1 Mar. 3, 2016

(30) Foreign Application Priority Data

Aug. 26, 2014 (TW) ..... 103129435 A

(51) Int. Cl.
*E05C 1/06* (2006.01)
*E05B 59/00* (2006.01)
(Continued)

(52) U.S. Cl.
CPC ..... *E05B 63/08* (2013.01); *E05B 59/00* (2013.01); *E05B 65/1086* (2013.01); *E05C 1/08* (2013.01)

(58) Field of Classification Search
CPC ..... E05B 65/0003; E05B 63/08; E05B 59/00; E05B 65/1086; E05B 63/0069; E05B 9/105; E05B 63/246; E05B 63/10; E05C 9/006; E05C 9/10; E05C 1/08; E05C 9/1841; E05C 292/145; E05C 1/04; E05C 1/10;
(Continued)

(56) References Cited

U.S. PATENT DOCUMENTS 4,583,382 A * 4/1986 Hull ..... E05B 59/00 70/107
5,819,562 A * 10/1998 Christ ..... E05B 59/00 292/34
(Continued)

FOREIGN PATENT DOCUMENTS

CN 101457606 A 6/2009
CN 201546498 U 8/2010
(Continued)

OTHER PUBLICATIONS

Taiwanese Office Action dated Jan. 12, 2016 for Taiwanese Patent Application No. 103129435, 7 pages.
(Continued)

*Primary Examiner* — Kristina Fulton
*Assistant Examiner* — Faria Ahmad
(74) *Attorney, Agent, or Firm* — Jackson IPG PLLC; Demian K. Jackson

(57) ABSTRACT

A lock structure includes a case, a first latch, a second latch, a transmission member, a transmission module, a swaying plate and a driving plate, wherein the transmission module is rotated to drive the swaying plate and the transmission member to perform swing action for making the swaying plate driving the first latch being hidden into the case. In addition, the driving plate moves upwardly by swing action of the transmission member, and the driving plate drives the second latch in operation for making the second latch being hidden into the case.

10 Claims, 9 Drawing Sheets

(51) Int. Cl.

| | |
|---|---|
| ***E05B 63/08*** | (2006.01) |
| ***E05C 1/08*** | (2006.01) |
| ***E05B 65/10*** | (2006.01) |
| *E05C 1/02* | (2006.01) |
| *E05C 1/12* | (2006.01) |
| *E05C 9/10* | (2006.01) |
| *E05C 9/16* | (2006.01) |
| *E05B 63/14* | (2006.01) |

(58) Field of Classification Search

CPC ..... E05C 292/175; B27F 5/12; Y10S 292/21; Y10S 292/36; Y10T 292/0836

USPC ..... 70/107–111; 292/33, 34, 35, 36, 37, 38, 292/137, 158

See application file for complete search history.

(56) References Cited

U.S. PATENT DOCUMENTS 6,125,670 A * 10/2000 Fuss ..... E05B 63/20 70/107
6,138,485 A * 10/2000 Fuss ..... E05B 47/0676 70/107
6,266,981 B1 * 7/2001 von Resch ..... E05B 63/0056 292/34
6,324,876 B1 * 12/2001 Prevot ..... E05B 15/0053 292/34
6,539,755 B1 * 4/2003 Bruwer ..... E05B 47/0012 292/165
6,851,287 B1 * 2/2005 Yang ..... E05B 65/1086 292/150
6,993,946 B1 * 2/2006 Shen ..... E05B 13/005 292/169.22
7,377,140 B2 * 5/2008 Shen ..... E05B 13/005 70/107
7,661,279 B2 * 2/2010 Huang ..... E05B 59/00 292/34
7,836,738 B2 * 11/2010 Tien ..... E05B 13/004 292/169.14
7,856,857 B2 * 12/2010 Tsai ..... E05C 9/004 292/34
8,199,011 B2 * 6/2012 Lu ..... E05B 45/06 340/542
8,234,892 B2 * 8/2012 Laverty ..... E05B 59/00 292/165
8,347,668 B2 * 1/2013 Min ..... E05B 59/00 292/165
8,419,084 B2 * 4/2013 Ding ..... E05B 47/0012 292/144
8,534,100 B2 * 9/2013 Tsai ..... E05C 9/1875 292/32
8,641,104 B1 * 2/2014 Tien ..... E05B 55/06 292/244
8,671,724 B2 * 3/2014 Uyeda ..... E05B 15/102 292/3
8,875,549 B2 * 11/2014 Chang ..... E05B 63/0021 292/34
9,074,391 B2 * 7/2015 Van Parys ..... E05B 65/06
2002/0104339 A1 * 8/2002 Saner ..... E05C 9/1841 70/108
2003/0079508 A1 * 5/2003 Lin ..... E05B 47/0692 70/107
2003/0159478 A1 * 8/2003 Nagy ..... E05B 15/0086 70/107
2004/0089033 A1 * 5/2004 Lu ..... E05B 59/00 70/107
2004/0107746 A1 * 6/2004 Chang ..... E05B 65/1086 70/107
2004/0194519 A1 * 10/2004 Chen ..... E05C 9/042 70/110
2005/0166647 A1 * 8/2005 Walls ..... E05C 9/20 70/107
2006/0123859 A1 * 6/2006 Gonzalez ..... E05B 59/00 70/107
2006/0191303 A1 * 8/2006 Shvarts ..... E05B 59/00 70/107
2006/0196236 A1 * 9/2006 Gruenendahl ..... E05B 55/12 70/107
2007/0051143 A1 * 3/2007 Raatikainen ..... E05B 47/0688 70/107
2007/0096475 A1 * 5/2007 Raatikainen ..... E05B 59/00 292/137
2007/0113603 A1 * 5/2007 Polster ..... E05B 63/16 70/107
2007/0245782 A1 * 10/2007 Shen ..... E05B 13/005 70/107
2008/0066505 A1 * 3/2008 Poletti ..... E05B 59/00 70/107
2008/0115545 A1 * 5/2008 Schumm ..... E05B 53/005 70/107
2008/0156048 A1 * 7/2008 Topfer ..... E05B 65/1086 70/77
2008/0156049 A1 * 7/2008 Topfer ..... E05B 65/1086 70/107
2008/0184749 A1 * 8/2008 Alber ..... E05C 7/06 70/103
2008/0202175 A1 * 8/2008 Riznik ..... E05B 63/185 70/77
2009/0145179 A1 * 6/2009 Chen ..... E05B 13/004 70/107
2009/0282877 A1 * 11/2009 Laverty ..... E05B 59/00 70/107
2010/0251786 A1 10/2010 Tsai
2010/0263416 A1 * 10/2010 Tsai ..... E05C 9/10 70/91
2010/0263418 A1 * 10/2010 Moon ..... E05B 55/00 70/107
2011/0062728 A1 * 3/2011 Tsai ..... E05B 59/00 292/336.3
2011/0175373 A1 * 7/2011 Ding ..... E05B 47/0012 292/144
2016/0002954 A1 * 1/2016 Ali ..... E05B 63/08 292/336.3
2016/0032622 A1 * 2/2016 Shin ..... E05B 63/08 292/145

FOREIGN PATENT DOCUMENTS

| | | |
|---|---|---|
| CN | 201649876 U | 11/2010 |
| CN | 103790447 A | 5/2014 |
| TW | 400405 | 8/2000 |
| TW | M303244 | 12/2006 |
| TW | M303958 | 1/2007 |
| TW | M429742 | 5/2012 |
| TW | M438523 | 10/2012 |

OTHER PUBLICATIONS

Chinese Office Action dated Jul. 26, 2017 for Chinese Patent Application No. 201410526643.X, 5 pages.

* cited by examiner

LOCK STRUCTURE

FIELD OF THE INVENTION

The present invention is generally relating to a lock structure. The present invention particularly represents the lock structure drives a transmission member and a swaying plate swing by rotating a transmission module to obtain a linkage unlocking effect.

BACKGROUND OF THE INVENTION

With reference to FIG. 9, a conventional lock structure 10 installed at a door includes a case 11, a first latch 12, a second latch 13 and a third latch 14. The first latch 12, the second latch 13 and the third latch 14 have to be driven respectively by a knob or a door key to lock the door when the door is closed. Similarly, the first latch 12, the second latch 13 and the third latch 14 still have to be driven respectively by the knob or the door key to unlock the door therefore leading to inconvenience of the user.

SUMMARY

The primary object of the present invention is to provide a lock structure including a case, a first latch, a second latch, a transmission member, a transmission module, a swaying plate and a driving plate. The case comprises an accommodating space, wherein the first latch and the second latch are disposed in the accommodating space, and a first head portion of the first latch and a second head portion of the second latch protrude to the case. The transmission member is swingably disposed in the accommodating space and comprises a first transmission portion, a second transmission portion and a third transmission portion. The transmission module is rotatably disposed in the accommodating space and comprises a first transmission plate and a second transmission plate, wherein the first transmission plate and the second transmission plate are engaged as one piece. The first transmission plate compresses the first transmission portion to perform swing action to make the second transmission portion swing toward a second direction opposite to a first direction and swing from a first position to a second position when the transmission module rotates towards the first direction. The second transmission plate compresses the third transmission portion to perform swing action to make the second transmission portion continuously swinging toward the second direction and swinging from the second position to a third position when the transmission module continues to rotate toward the first direction. The swaying plate is swingably disposed in the accommodating space and used for driving the first latch in operation. The first transmission plate drives the swaying plate to perform swing action to make the swaying plate driving the first latch in operation and making the first head portion being hidden into the case when the first transmission plate compresses the first transmission portion to swing. The driving plate is movably disposed in the accommodating space and used for driving the second latch in operation. The second transmission portion drives the driving plate to move upwardly to drive the second latch in operation and make the second head portion being hidden into the case when the second transmission portion swings from the second position to the third position.

In this invention, the swaying plate drives the first latch in operation and the transmission member drives the driving plate to move upwardly to drive the second latch in operation to obtain the objective that the transmission module drives the first latch and second latch to unlock the door by rotating the transmission module to drive the swaying plate and the transmission member swinging respectively.

DETAILED DESCRIPTION OF THE INVENTION

Figure 1:
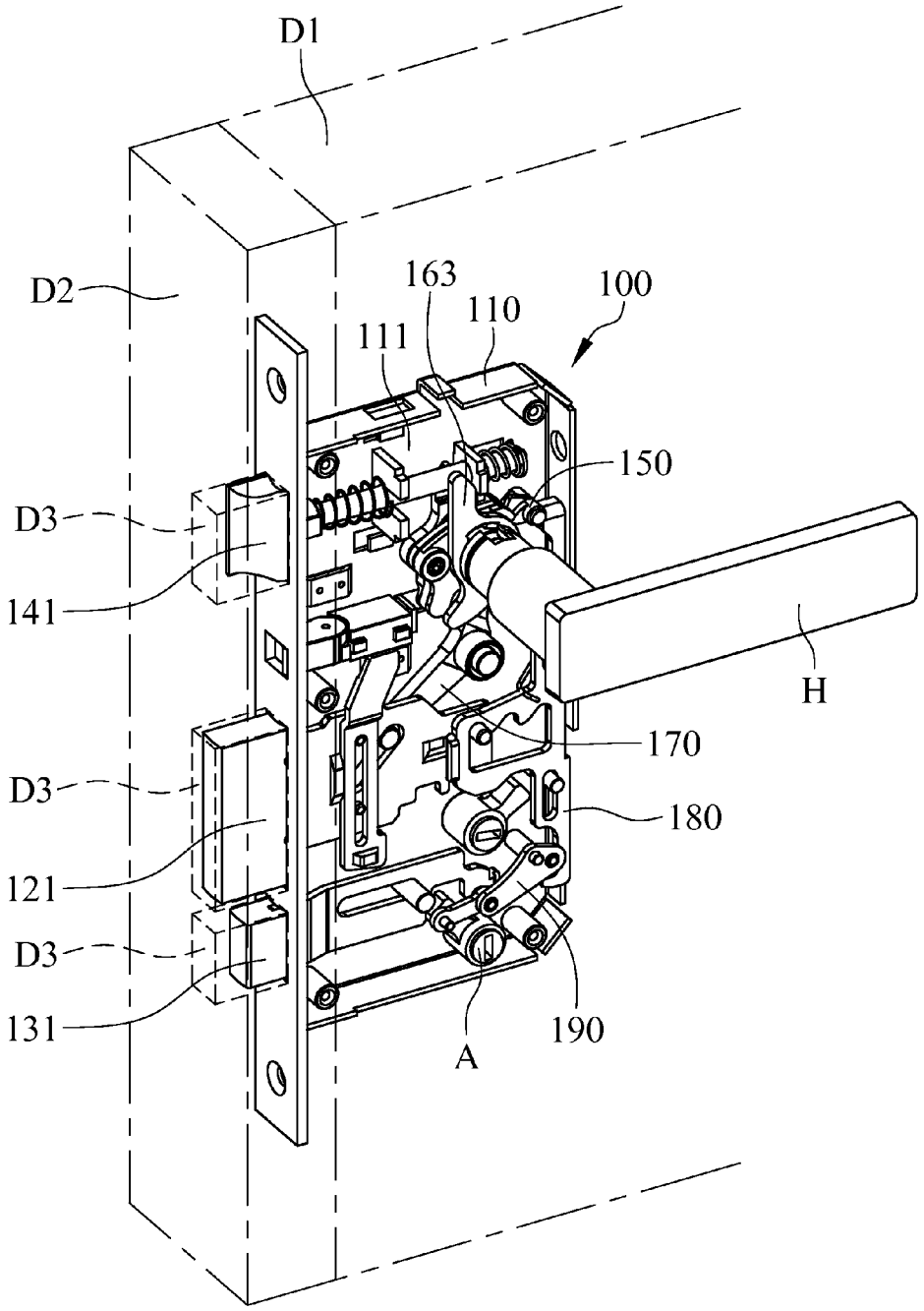
FIG. 1 is a perspective diagram illustrating a lock structure disposed at a door in accordance with the present invention.
Figure 2:
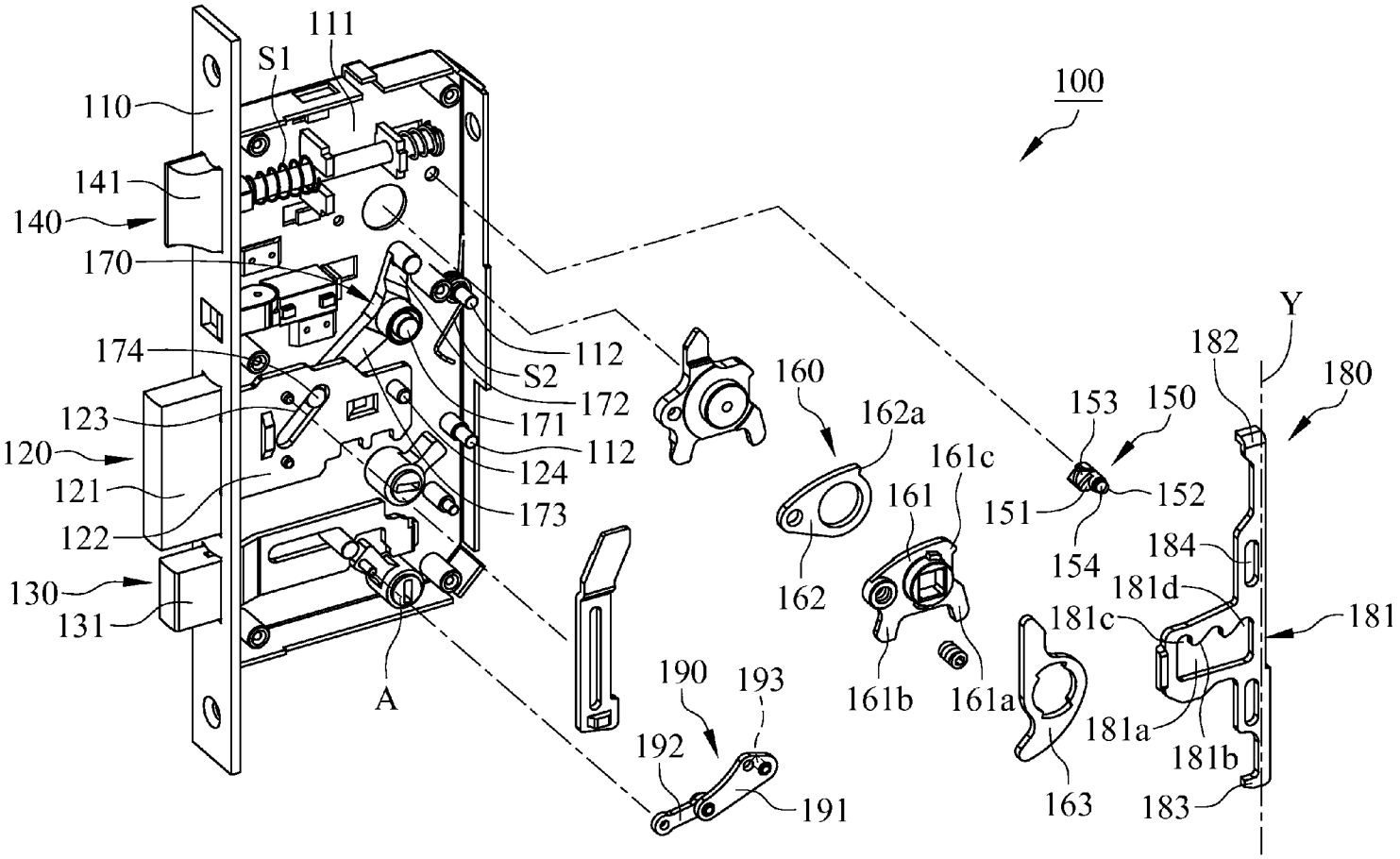
FIG. 2 is a perspective exploded diagram illustrating the lock structure in accordance with the present invention.

With reference to FIGS. 1 and 2, a lock structure 100 is disclosed in accordance with an embodiment of the present invention, wherein the lock structure 100 and a handle H used for driving the lock structure 100 in operation are installed at a door D1. The lock structure 100 includes a case 110, a first latch 120, a second latch 130 and a third latch 140, wherein the case 110 comprises an accommodating space 111, and the first latch 120, the second latch 130 and the third latch 140 are disposed in the accommodating space 111. The first latch 120 and the second latch 130 are driven to make a first head portion 121 of the first latch 120 and a second head portion 131 of the second latch 130 protruding to the case 110 and inserting into a limiting hole D3 of a door frame D2 for restricting the door D1 from being opened when the door D1 is closed. In this embodiment, the third latch 140 is pushed by a spring S1, and a third head portion 141 of the third latch 140 protrudes to the case 110. The third head portion 141 protrudes to the case 110 and inserts into the limiting hole D3 of the door frame D2 when the door D1 is closed.

Figure 3:
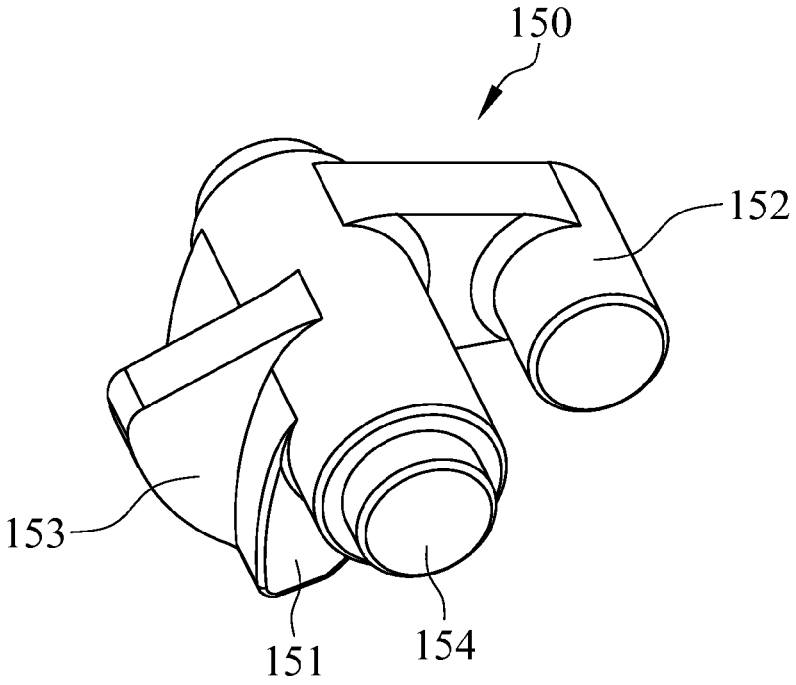
FIG. 3 is a perspective diagram illustrating a transmission member in accordance with the present invention.

With reference to FIGS. 2 and 3, the lock structure 100 further includes a transmission member 150 swingably disposed in the accommodating space 111. The transmission member 150 comprises a first transmission portion 151, a second transmission portion 152, a third transmission portion 153 and a shaft portion 154. In this embodiment, the first transmission portion 151, the second transmission portion 152 and the third transmission portion 153 are formed as one piece on the shaft portion 154 and protrude to the shaft portion 154. The shaft portion 154 is pivotally connected to the case 110, wherein the first transmission portion 151, the second transmission portion 152 and the third transmission portion 153 swing in the accommodating space 111 by using the shaft portion 154 as center point.

With reference to FIG. 2, the lock structure 100 further includes a transmission module 160 rotatably disposed in the accommodating space 111, wherein the transmission module 160 comprises a first transmission plate 161, a second transmission plate 162 and a third transmission plate 163. The first transmission plate 161, the second transmission plate 162 and the third transmission plate 163 are engaged as one piece and rotate simultaneously. In this embodiment, the first transmission plate 161 comprises a first protrusion portion 161*a*, a second protrusion portion 161*b* and a compression portion 161*c*, wherein the compression portion 161*c* of the first transmission plate 161 is used for pushing the first transmission portion 151 to perform swing action, and the second transmission plate 162 comprises a pushing portion 162*a* used for pushing the third transmission portion 153 for making the second transmission portion 152 swinging continuously.

With reference to FIG. 2, the lock structure 100 further includes a swaying plate 170 swingably disposed in the accommodating space 111, wherein the first protrusion portion 161*a* and the second protrusion portion 161*b* of the first transmission plate 161 are used for driving the swaying plate 170 to perform swing action. The swaying plate 170 is used for driving the first latch 120 in operation. In this embodiment, the swaying plate 170 comprises a center portion 171, a first arm portion 172 and a second arm portion 173, wherein the first arm portion 172 and the second arm portion 173 are located at two sides of the center portion 171 respectively. The first arm portion 172 and the second arm portion 173 swing in the accommodating space 111 by using the center portion 171 as center point. A distal end of the first arm portion 172 extends to a space between the first protrusion portion 161*a* and the second protrusion portion 161*b* so that one of the first protrusion portion 161*a* and the second protrusion portion 161*b* pushes the first arm portion 172 to make the second arm portion 173 swinging.

With reference to FIG. 2, in this embodiment, the first latch 120 comprises a latch body 122 connected to the first head portion 121, wherein the latch body 122 comprises a long slot 123, the second arm portion 173 of the swaying plate 170 comprises a protrusion pillar 174 that penetrates through the long slot 123 and is capable of moving in the long slot 123 to push the first latch 120 in operation.

Referring to FIG. 2, the lock structure 100 further includes a driving plate 180 movably disposed in the accommodating space 111, wherein the driving plate 180 is used for driving the second latch 130 in operation. The driving plate 180 comprises a limiting portion 181, a first end portion 182 and a second end portion 183, wherein the first end portion 182 and the second end portion 183 are located at two sides of the limiting portion 181 respectively, the second transmission portion 152 of the transmission member 150 pushes the first end portion 182 to make the driving plate 180 moving along a longitudinal direction Y. In this embodiment, the second transmission portion 152 pushes the first end portion 182 to make the driving plate 180 moving upwardly.

Referring to FIG. 2, the limiting portion 181 of the driving plate 180 comprises a limiting hole 181*a*, and the latch body 122 of the first latch 120 comprises a limiting pillar 124 which is constrained in the limiting hole 181*a*. Preferably, a first notch 181*c* and a second notch 181*d* are recessed into a lateral wall 181*b* of the limiting hole 181*a*, and the limiting pillar 124 is selectively constrained in the first notch 181*c* or the second notch 181*d*.

With reference to FIG. 2, in this embodiment, the limiting portion 181 comprises a guiding slot 184, and the case 110 comprises a guiding pillar 112, wherein the guiding pillar 112 penetrates through the guiding slot 184 and restricts the driving plate 180 to move along the longitudinal direction Y only.

With reference to FIG. 2, the lock structure 100 further includes a linking member 190 and a knob A, wherein the knob A is moveably disposed in the accommodating space 111. The second end portion 183 of the driving plate 180 is used for pushing the linking member 190 in operation, and the knob A is driven to perform swing action by the linking member 190. In this embodiment, the linking member 190 comprises a first linking plate 191 and a second linking plate 192, wherein the first linking plate 191 is pivotally disposed in the case 110, one end of the second linking plate 192 connects to the first linking plate 191, and the other end of the second linking plate 192 connects to the knob A.

With reference to FIGS. 4 to 8, mentioned figures represent the operation diagrams that the lock structure 100 is driven by the handle H to unlatch the first latch 120, the second latch 130 and the third latch 140.

Figure 4:
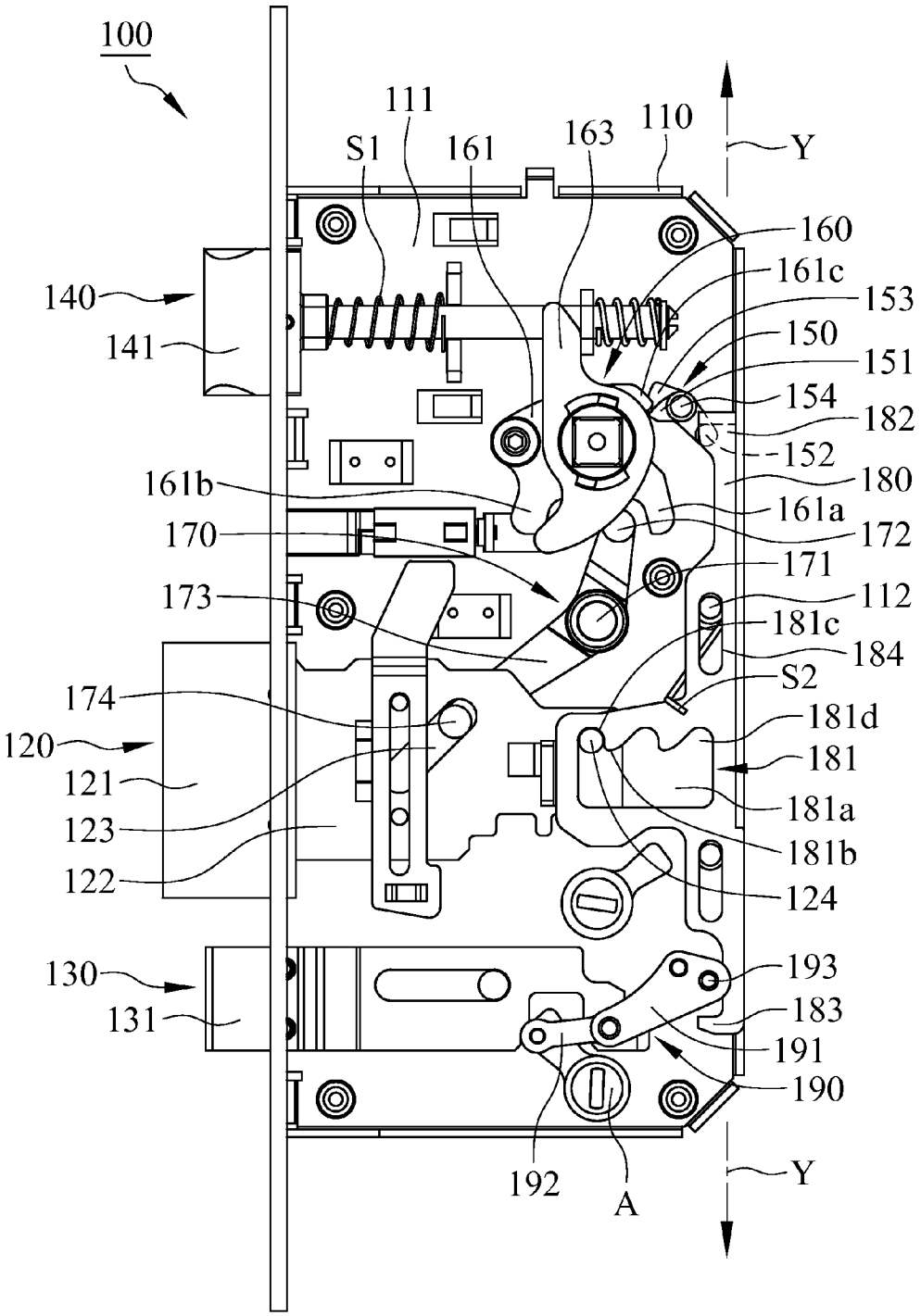
FIGS. 4 to 8 are operation diagrams illustrating the lock structure in accordance with the present invention.

With reference to FIGS. 1 and 4, the first head portion 121 of the first latch 120, the second head portion 131 of the second latch 130 and the third head portion 141 of the third latch 140 protrude to the case 110. First, referring to FIGS. 2, 3 and 4, the compression portion 161*c* of the first transmission plate 161 corresponds to the first transmission portion 151 of the transmission member 150, the second transmission portion 152 of the transmission member 150 corresponds to the first end portion 182 of the driving plate 180, the second end portion 183 of the driving plate 180 corresponds to a protrusion pillar 193 of the linking member 190, the first protrusion portion 161*a* of the first transmission plate 161 corresponds to the first arm portion 172 of the swaying plate 170, the protrusion pillar 174 of the second arm portion 173 penetrates through the long slot 123, and the limiting pillar 124 of the latch body 122 is constrained in the first notch 181*c* to prevent the first latch 120 from being hidden into the case 110.

Figure 5:
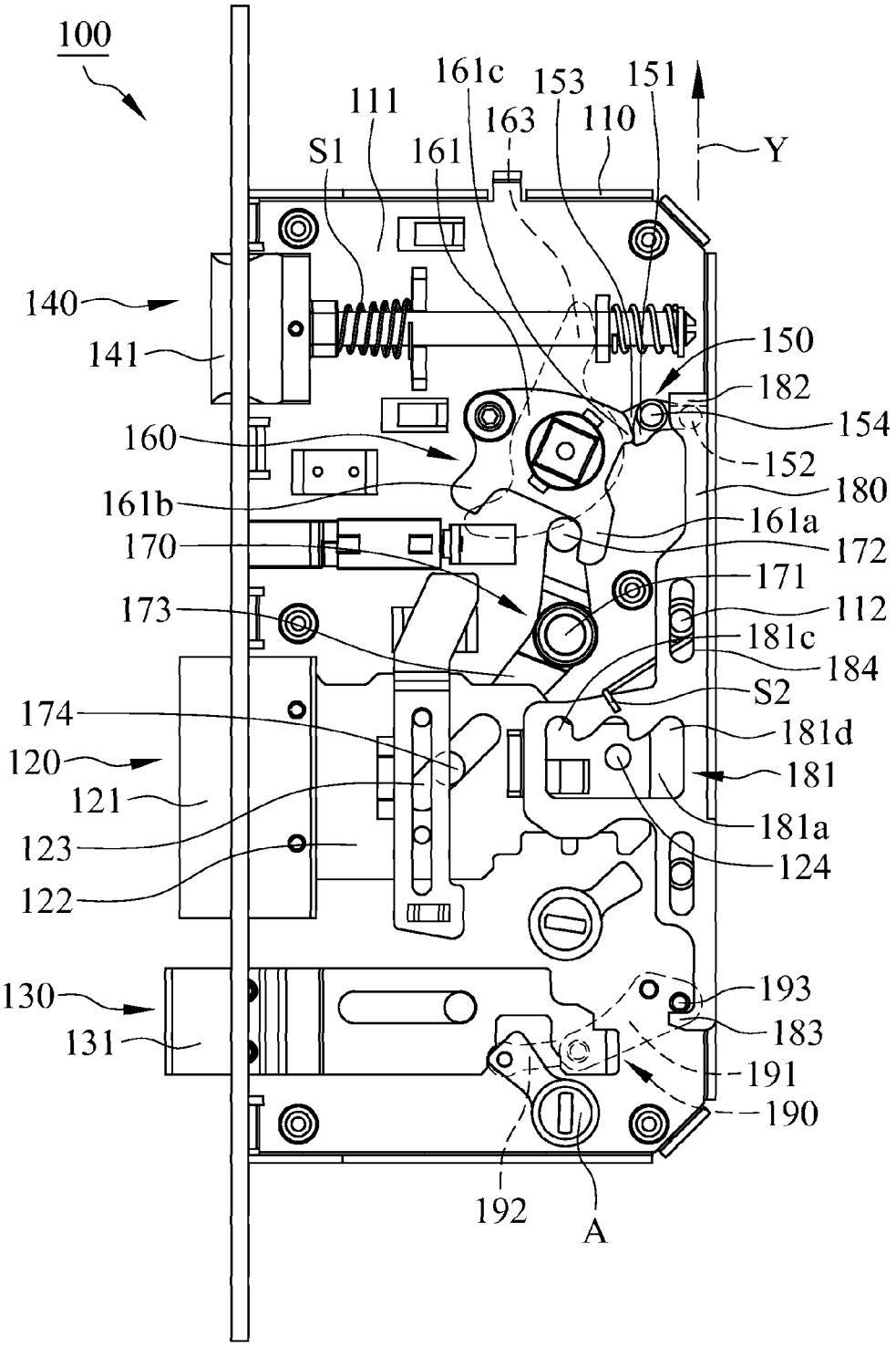

Next, referring to FIGS. 1, 2 and 5, the handle H drives the transmission module 160 of the lock structure 100 to rotate toward a first direction when a force apply to the handle H. In this embodiment, the first direction is clockwise. Owing to the first transmission plate 161, the second transmission plate 162 and the third transmission plate 163 are engaged as one piece, the third transmission plate 163 drives the third latch 140 in operation to make the third head portion 141 being hidden into the case 110 when the transmission module 160 rotates in the first direction.

Referring to FIGS. 1, 2 and 5, additionally, the compression portion 161*c* of the first transmission plate 161 presses the first transmission portion 151 to make the first transmission portion 151, the second transmission portion 152 and the third transmission portion 153 swinging toward a second direction opposite to the first direction and make the second transmission portion 152 swinging from a first position to a second position when the transmission module 160 rotates in the first direction. In this embodiment, the second direction is counterclockwise. And the second transmission portion 152 pushes the first end portion 182 of the driving plate 180 to make the driving plate 180 moving upwardly, meanwhile, the limiting pillar 124 departs from the first notch 181*c*.

Referring to FIGS. 1, 2 and 5, in addition, the first transmission plate 161 also drives the swaying plate 170 to perform swing action when the transmission module 160 rotates in the first direction. In this embodiment, the first protrusion portion 161*a* of the first transmission plate 161 pushes the first arm portion 172 of the swaying plate 170 to make the second arm portion 173 of the swaying plate 170 swinging toward the second direction. By swinging action of the second arm portion 173, the protrusion pillar 174 penetrating through the long slot 123 enables to drive the first latch 120 in operation and makes the first head portion 121 being hidden into the case 110.

Figure 6:
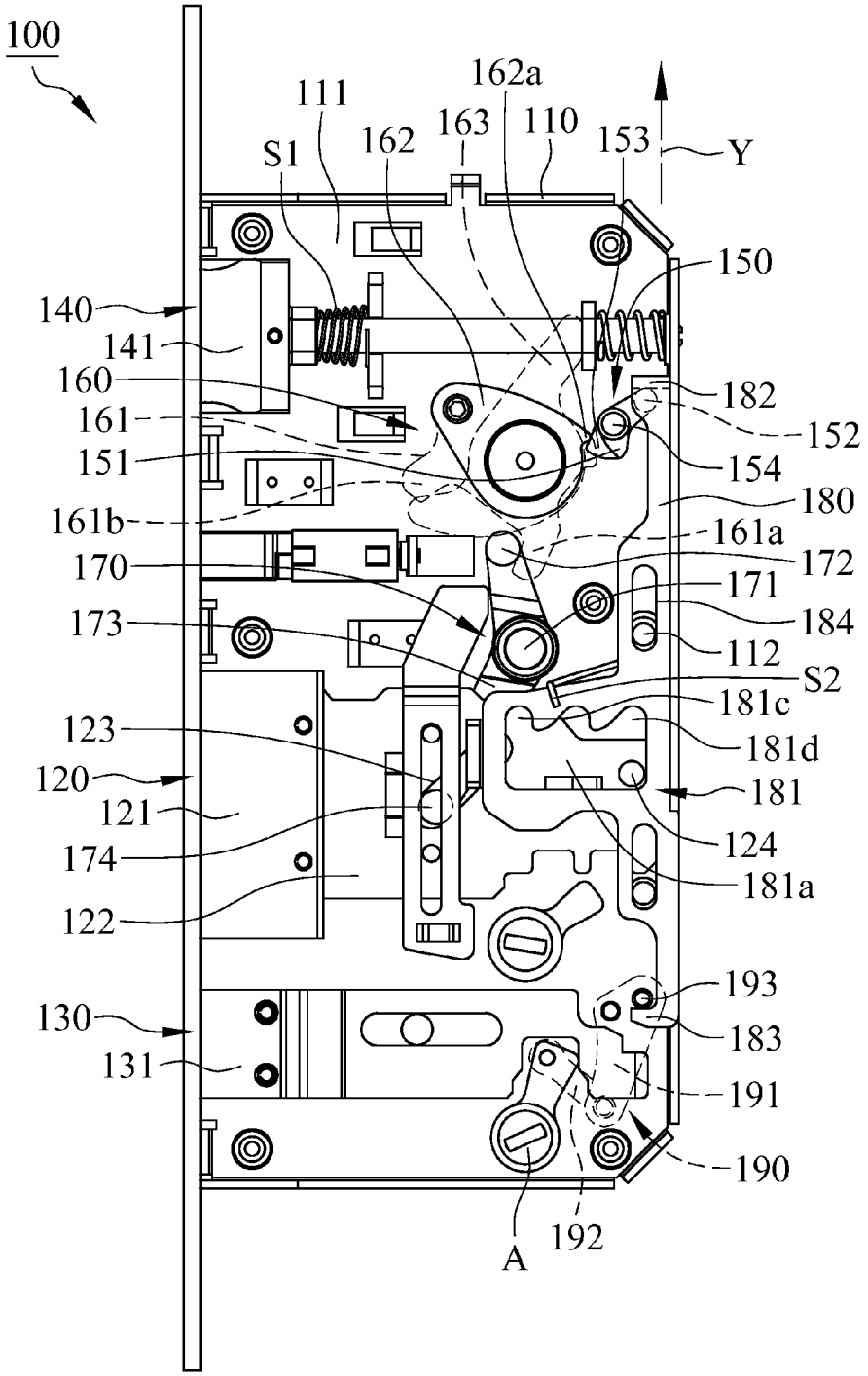

Referring to FIGS. 1, 2 and 6, the handle H constantly drives the transmission module 160 of the lock structure 100 to rotate continuously in the first direction when apply the force to the handle H continuously.

Referring to FIGS. 1, 2 and 6, the pushing portion 162*a* of the second transmission plate 162 compresses the third transmission portion 153 to make the second transmission portion 152 continuously swinging toward the second direction and swinging from the second position to a third position when the transmission module 160 constantly rotates in the first direction, wherein the second transmission portion 152 constantly pushes the first end portion 182 of the driving plate 180 to drive the driving plate 180 continuously moving upwardly and make the driving plate 180 driving the linking member 190 in operation. In this embodiment, the second end portion 183 of the driving plate 180 drives the first linking plate 191 in rotation and makes the first linking plate 191 driving the second linking plate 192 to move. Next, the second linking plate 192 drives the knob A in swing action. Later, the knob A drives the second latch 130 to make the second head portion 131 being hidden into the case 110.

Referring to FIGS. 1, 2 and 6, the first protrusion portion 161*a* of the first transmission plate 161 continues to push the first arm portion 172 of the swaying plate 170 to make the second arm portion 173 of the swaying plate 170 constantly swinging toward the second direction when the transmission module 160 constantly rotates in the first direction. The first latch 120 is driven to make the first head portion 121 being hidden into the case 110 by swing action of the second arm portion 173.

Figure 7:
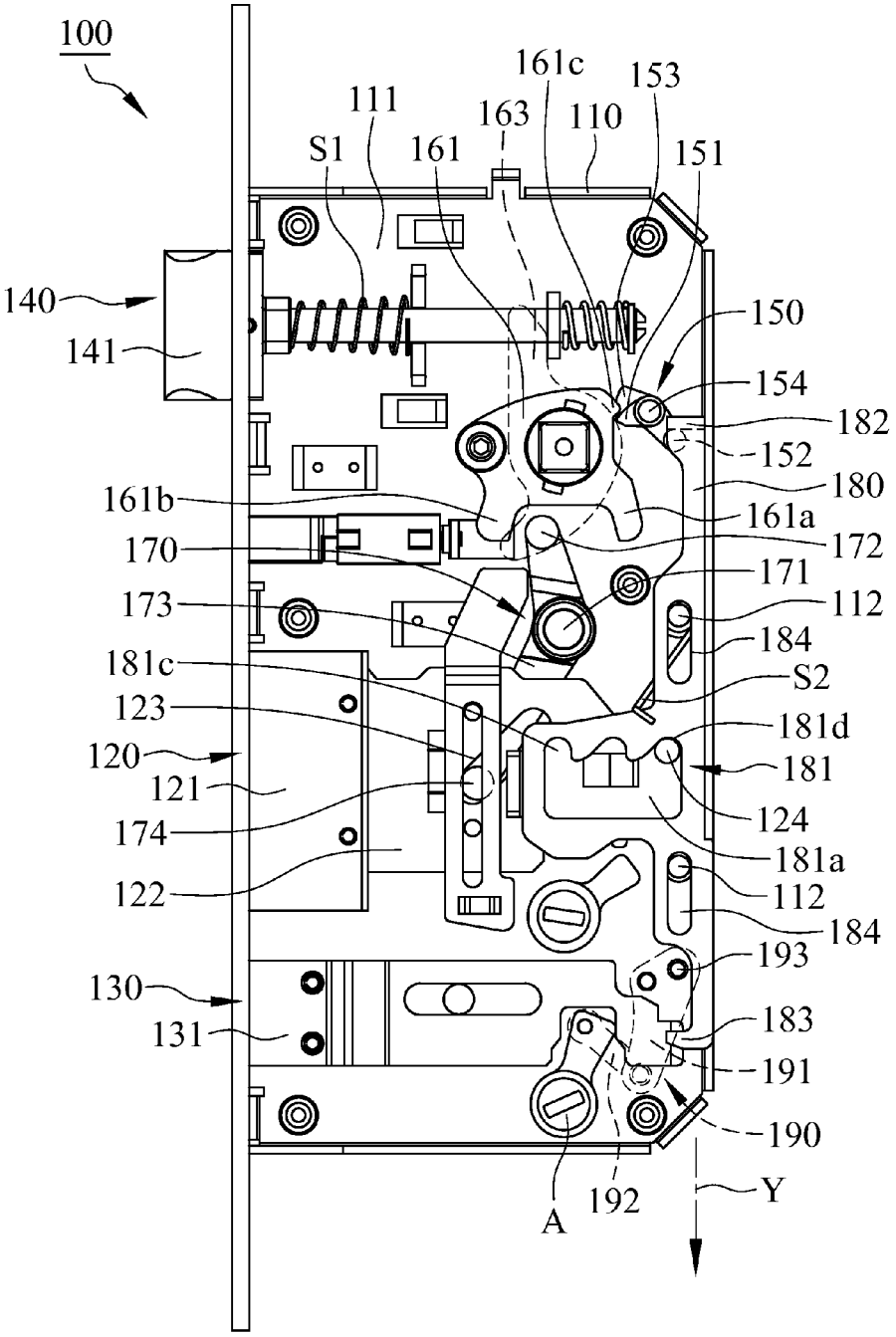

Referring to FIGS. 1, 2 and 7, eventually, as long as the forces applying to the handle H eliminate, an elastic member S2 compresses the driving plate 180 to make the driving plate 180 moving downwardly along the longitudinal direction Y therefore making the limiting pillar 124 constrained in the second notch 181*d* of the limiting portion 181.

In this invention, rotates the transmission module 160 to make the first transmission plate 161 of the transmission module 160 driving the swaying plate 170 to perform swing action and making the swaying plate 170 driving the first latch 120 in operation, and the second transmission plate 162 of the transmission module 160 drives the transmission member 150 to perform swing action to make the transmission member 150 driving the driving plate 180 moving upwardly, and the driving plate 180 drives the second latch 130 in operation to achieve the function for unlocking the first latch 120 and the second latch 130 by the transmission module 160.

Figure 8:
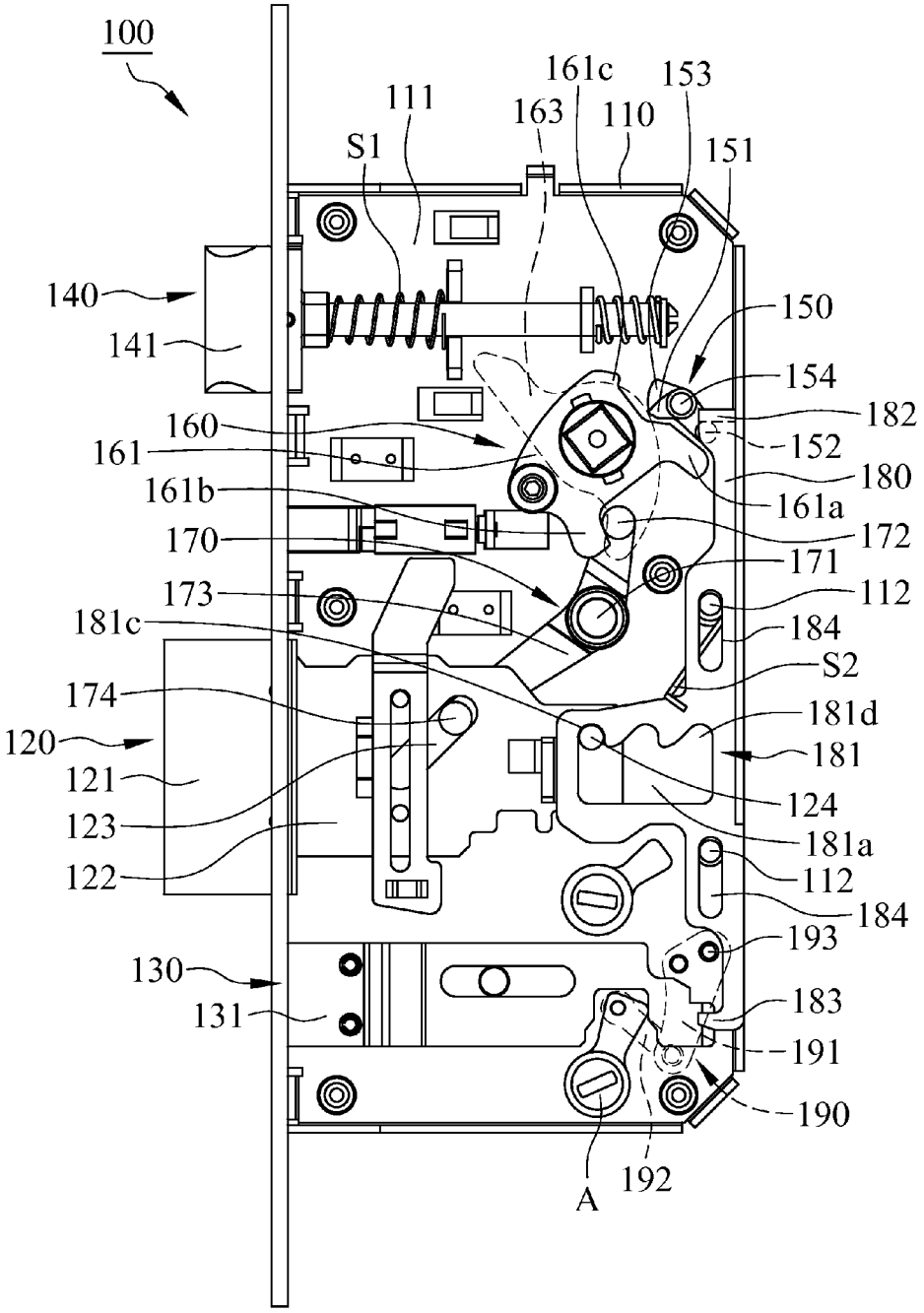
Figure 9:
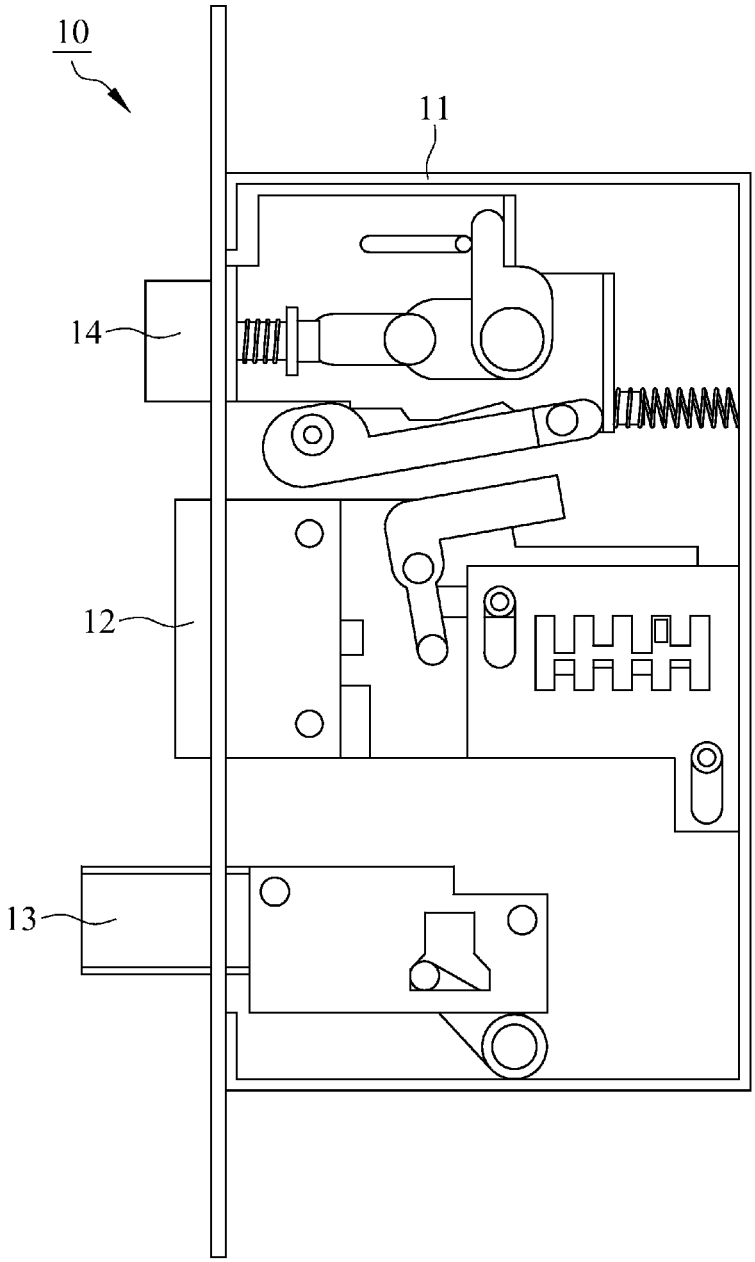
FIG. 9 PRIOR ART
FIG. 9 is a lateral view of a conventional lock structure.

With reference to FIGS. 1, 2 and 8, in this embodiment, after the first head portion 121 of the first latch 120 hidden into the case 110, apply a force to the handle H to make the transmission module 160 rotating toward the second direction, and the second protrusion portion 161*b* of the first transmission plate 161 pushes the first arm portion 172 of the swaying plate 170 to make the second arm portion 173 of the swaying plate 170 swing toward the first direction. By swing action of the second arm portion 173, the protrusion pillar 174 penetrating through the long slot 123 drives the first latch 120 in operation, and the first head portion 121 of the first latch 120 protrudes to the case 110 and inserts into the limiting hole D3 of the door frame D2 for restricting the door D1 from being opened. Additionally, the limiting pillar 124 of the latch body 122 is moved from the second notch 181*d* to the first notch 181*c* to prevent the first latch 120 from being hidden into the case 110.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A lock structure comprising:

a case having an accommodating space;

a first latch disposed in the accommodating space, wherein a first head portion of the first latch protrudes to the case;

a second latch disposed in the accommodating space, wherein a second head portion of the second latch protrudes to the case;

a transmission member swingably disposed in the accommodating space comprises a first transmission portion, a second transmission portion and a third transmission portion;

a transmission module rotatably disposed in the accommodating space comprises a first transmission plate and a second transmission plate, wherein the first transmission plate and the second transmission plate are engaged as one piece, the first transmission plate abuts the first transmission portion to make the second transmission portion swinging toward a second direction opposite to a first direction and swinging from a first position to a second position when the transmission module rotates toward the first direction, and the second transmission plate abuts the third transmission portion to make the second transmission portion continuously swinging toward the second direction and swinging from the second position to a third position when the transmission module continues to rotate toward the first direction;

a swaying plate swingably disposed in the accommodating space is used for driving the first latch in operation, the first transmission plate drives the swaying plate to perform swing action for making the swaying plate driving the first latch in operation and making the first head portion being hidden into the case when the first transmission plate abuts the first transmission portion; and a driving plate movably disposed in the accommodating space is used for driving the second latch in operation, the second transmission portion drives the driving plate to move upwardly for making the driving plate driving the second latch in operation and making the second head portion being hidden into the case when the second transmission portion swings from the second position to the third position, wherein, the first transmission plate and the second transmission plate drives the first transmission portion and the third transmission portion respectively to enable the transmission member to achieve two-stage rotation and further to drive the first latch and the second latch with different strokes.

2. The lock structure in accordance with claim 1 further comprising a linking member, wherein the linking member is driven to be in operation by the driving plate when the driving plate moves upwardly.

3. The lock structure in accordance with claim 2 further comprising a knob moveably disposed in the accommodating space, wherein the linking member drives the knob to swing to drive the second latch in operation for making the second head portion being hidden into the case.

4. The lock structure in accordance with claim 1, wherein the driving plate comprises a limiting portion having a limiting hole, the first latch comprises a latch body connected to the first head portion, the latch body comprises a limiting pillar which is constrained in the limiting hole.

5. The lock structure in accordance with claim 4, wherein a first notch and a second notch are recessed into a lateral wall of the limiting hole, and the limiting pillar is selectively constrained in the first notch or the second notch.

6. The lock structure in accordance with claim 4, wherein the limiting portion comprises a guiding slot, and the case comprises a guiding pillar, the guiding pillar penetrates through the guiding slot and restricts movement of the driving plate along a longitudinal direction.

7. The lock structure in accordance with claim 4, wherein the latch body comprises a long slot, and the swaying plate comprises a protrusion pillar that penetrates through the long slot.

8. The lock structure in accordance with claim 1, wherein the second transmission plate comprises a pushing portion, the second transmission plate pushes the third transmission portion by the pushing portion.

9. The lock structure in accordance with claim 1, wherein the first transmission plate comprises a first protrusion portion and a second protrusion portion, the first protrusion portion pushes the swaying plate to make the swaying plate swinging toward the second direction to drive the first latch in operation and make the first head portion being hidden into the case when the transmission module rotates toward the first direction, the second protrusion portion pushes the swaying plate to make the swaying plate swinging toward the first direction to drive the first latch in operation and make the first protrusion portion protrude to the case when the transmission module rotates toward the second direction.

10. The lock structure in accordance with claim 1 further comprising a third latch disposed in the accommodating space, wherein a third head portion of the third latch protrudes to the case, the transmission module further comprises a third transmission plate, the third transmission plate drives the third latch in operation to make the third head portion being hidden into the case when the transmission module rotates in the first direction.

* * * * *